United States Patent [19]

Deeg et al.

[11] Patent Number: 4,605,573

[45] Date of Patent: Aug. 12, 1986

[54] METHODS AND APPARATUS FOR APPLYING A FINISH LIQUID TO A BUNDLE OF FILMENTARY MATERIAL

[75] Inventors: Martin H. G. Deeg, Maplewood; Gunilla E. Gillberg-LaForce, Summit; Alan Buckley, Berkeley Heights, all of N.J.

[73] Assignee: Celanese Corporation, New York, N.Y.

[21] Appl. No.: 700,563

[22] Filed: Feb. 11, 1985

[51] Int. Cl.[4] ..... B05D 1/00

[52] U.S. Cl. ..... 427/424; 427/394; 427/434.6; 118/401; 118/410; 118/420; 118/405

[58] Field of Search ..... 427/434.2, 434.6, 424, 427/394; 118/401, 410, 420, 405

[56] References Cited

U.S. PATENT DOCUMENTS

| | | | |
|---|---|---|---|
| 2,064,932 | 12/1936 | MacKenzie . | |
| 2,562,500 | 7/1951 | Lunt et al. . | |
| 2,861,393 | 11/1958 | Whitehurst et al. . | |
| 3,073,000 | 1/1963 | Gonsalves et al. . | |
| 3,201,275 | 8/1965 | Herrick . | |
| 3,422,796 | 1/1969 | Baber | 118/411 |
| 4,042,360 | 8/1977 | Kane | 118/420 |
| 4,253,416 | 3/1981 | Williams, Jr. . | |
| 4,255,472 | 3/1981 | Williams | 118/401 |
| 4,255,473 | 3/1981 | Williams, Jr. . | |

*Primary Examiner*—Richard Bueker

*Attorney, Agent, or Firm*—Burns, Doane, Swecker & Mathis

[57] ABSTRACT

Finish liquid is applied to a bundle of running filamentary material by running the bundle of filamentary material in monolayer form through a passage and conducting finish liquid under pressure through at least two side-by-side capillaries each having a diameter less than 0.06 inches. The finish liquid is discharged through outlet ends of the capillaries and onto the running monolayer of filamentary material. Preferably, the capillaries are separated by a divider wall which terminates short of the outlet ends of the capillaries, whereby those outlet ends define a slot through which the finish liquid is discharged. The slot preferably has end portions which are narrower than a center portion of the slot.

14 Claims, 6 Drawing Figures

METHODS AND APPARATUS FOR APPLYING A FINISH LIQUID TO A BUNDLE OF FILMENTARY MATERIAL

BACKGROUND AND OBJECTS OF THE INVENTION

The present invention relates to the manufacture of man-made filamentary material and, in particular, to the application of a finishing liquid to the filamentary material.

The manufacture of man-made filamentary material is achieved, for example, by extruding a molten polymer, such as polyester, polyamide, etc., through a spinneret and then cooling the filamentary material thus formed. At some point in the process a finishing liquid may be applied to the filamentary material in order to impart a desired property thereto, such as smoothness, drape, luster, water repellency, flame retardancy, and crease resistance, for example. It will be appreciated that the quality of the filamentary material thus produced is affected by the uniformity of the application of the finishing liquid.

It has been heretofore difficult to achieve a uniform application of the finish fluid onto the filamentary material, which may be in the form of individual filaments or bundles of filamentary yarn. That difficulty intensifies with increases in denier and/or running speeds and is not alleviated by conventional finish applicators in which filaments or filamentary yarn bundles are gathered together and sprayed with finish. It is difficult in such a case to uniformly reach all of the filamentary material with finish liquid. Furthermore, there often occur pulsations in the flow of finish liquid through the spray passages or capillaries, whereby the application of the liquid becomes non-uniform along the longitudinal dimension of the filamentary material, i.e., in the direction of filament travel.

It is, therefore, an object of the present invention to provide novel methods and apparatus for applying a finish fluid to filamentary material in a more uniform manner.

An additional object is to minimize or prevent the occurrence of pressure pulses or surges in the capillaries which conduct the finish liquid.

SUMMARY OF THE INVENTION

These objects are achieved by the present invention which relates to a method of applying a finish liquid to a bundle of running filamentary material, and an apparatus for performing the method. In carrying out the method, a bundle of filamentary material is run in monolayer form through a passage. Finish liquid is conducted under pressure through at least two side-by-side capillaries each having a diameter less than 0.06 inches. Finish liquid is discharged through outlet ends of the capillaries and onto the running monolayer or filamentary material.

Preferably, the finish liquid is conducted through capillaries which are separated by a divider wall that terminates short of the outlet ends of the capillaries, whereby the finish liquid is discharged through a slot defined by the outlet ends or the capillaries.

The present invention also involves an applicator for applying the finish liquid to the bundle of running filamentary material. The applicator comprises a passage having a width at least as long as the sum of the thicknesses of the filamentary material so that the filamentary material forms a monolayer while running through the passage. At least two capillaries extend side-by-side and each have an inlet end for receiving finish liquid under pressure and an outlet end. The outlet ends are arranged to discharge finish liquid onto the running monolayer of filamentary material. The capillaries each have a diameter less than 0.06 inches.

Preferably, the capillaries are separated by a divider wall which terminates short of the outlet ends of the capillaries such that the outlet ends define a slot from which the finish liquid is discharged. It is preferable that the slot be narrower at its ends than at its center so as to discharge a greater amount of finish material at the center where it is likely that the filamentary material may be bunched.

THE DRAWINGS

The objects and advantages of the invention will become apparent from the following detailed description of preferred embodiments thereof in connection with the accompanying drawings in which like numerals designate like elements, and in which.

DETAILED DESCRIPTION OF PREFERRED EMBODIMENTS OF THE INVENTION

Figure 1:
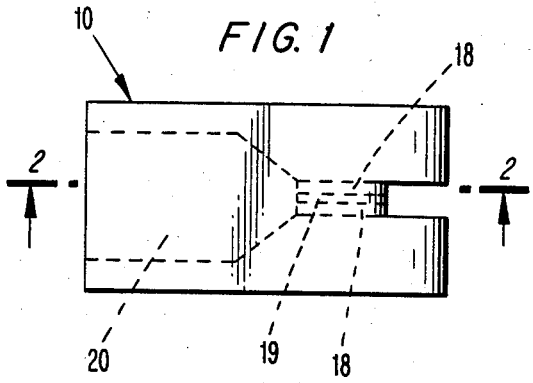
FIG. 1 is a top plan view of an applicator according to the present invention.
Figure 2:
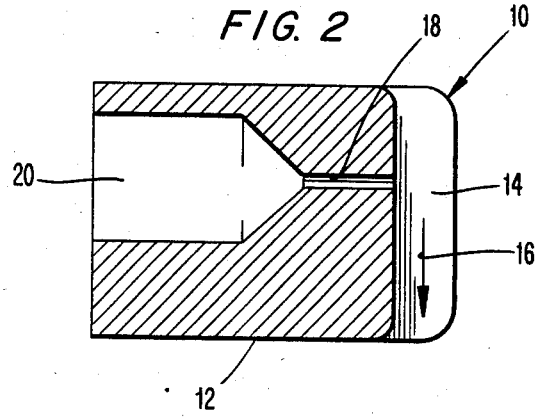
FIG. 2 is a vertical sectional view taken along line 2—2 in FIG. 1.
Figure 3:
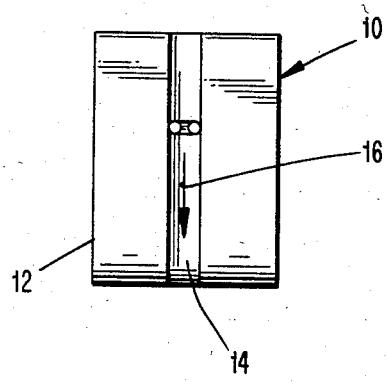
FIG. 3 is a front elevational view of the applicator.

A finish applicator 10 according to the present invention is depicted in FIGS. 1–3 and comprises a housing 12 containing an open-ended upright passage 14 for accommodating a bundle of filamentary material which may comprise a bundle of individual filaments or a bundle of filamentary yarn for example. The width of the passage is greater than the sum of the diameters in the bundle so that the bundle is constrained to travel through the passage in a vertical direction 16 as a monolayer of filamentary material in the form of a flat ribbon.

Communicating with the passage 14 at a location intermediate its upper and lower ends is ducting for finish fluid. The ducting preferably comprises at least two capillaries 18 of circular cross-section arranged side-by-side within the housing and separated by a divider wall 19. The inlet ends of the capillaries communicate with a larger supply duct 20 which, in turn, communicates with a source of finish liquid under pressure (not shown). The divider wall 19 may extend all the way to the end of the outlet ends of the capillaries 18 as depicted in FIG. 1.

Figure 4:
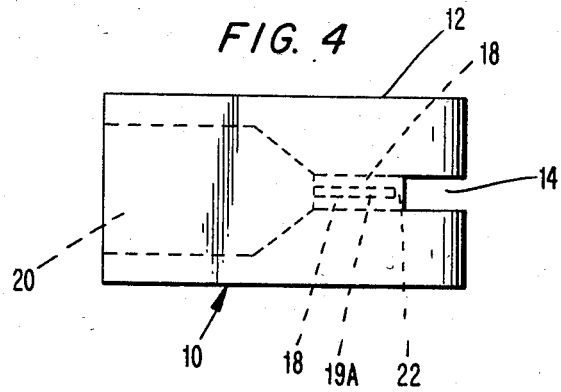
FIG. 4 is a plan view of a modified form of applicator.
Figure 5:
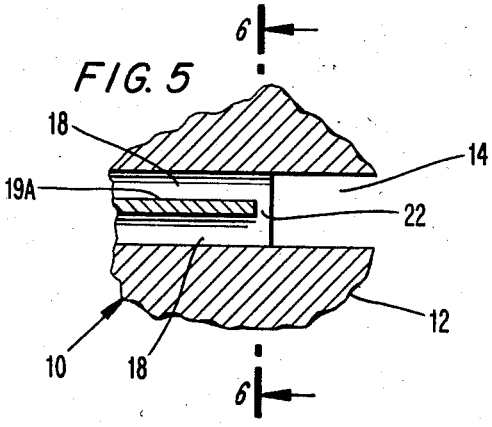
FIG. 5 is an enlarged fragmentary view of a portion of the modified applicator depicted in FIG. 4.
Figure 6:
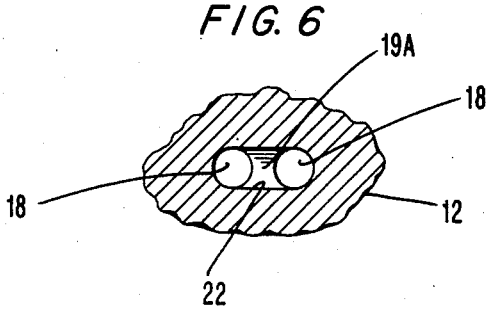
FIG. 6 is a cross-sectional view taken along line 6—6 in FIG. 5.

Alternatively, the divided wall 19A may terminate short of the outlet ends of the capillaries as depicted in FIGS. 4–6 whereby those outlet ends form part of a common slot 22 from which the finish liquid is discharged. The formation of such a slot is advantageous because the liquid sprayed therefrom is of a more uniform density immediately downstream of the slot, since the divider wall is not present to create a region between the capillaries where no liquid is discharged.

It is desirable that the vertical depth of the slot 22 be minimized so that the characteristics of the liquid discharge are controlled primarily by the capillaries themselves. Also, the slot 22 can be shaped so as to be narrower at its ends than at its center (i.e., see FIG. 6) so that a greater concentration of liquid spray occurs at the slot center where the filamentary material may be concentrated.

The capillaries 18 are designed to prevent pressure pulsations. That is, it has been learned that by making the diameter of all capillaries less than 0.06 inches in diameter, no appreciable pressure pulsations will occur in the capillary. This means that liquid finish will be applied uniformly along the lengths of the filamentary material, i.e., in the direction of filamentary travel, since the liquid flow will not be interrupted to any appreciable extent as the filamentary material travels through the passage.

It is preferable that in cases where two capillaries are employed, the capillary diameter be 0.03 inches. In cases where three capillaries are employed, it is desirable that the capillary diameter be about 0.02 inches.

In one preferred embodiment of the invention, each capillary has a diameter of 1/32 inches and is 3/16 inches in length. Preferably, all or both capillaries have the same diameter.

It is also desirable that the capillaries be perpendicular or at least substantially perpendicular relative to the vertical path of travel of the filamentary material. The applicator will still be effective if the capillaries are inclined slightly upwardly or downwardly relative to horizontal e.g., by about ±20 degrees.

It will be appreciated that the present invention enables a bundle of filamentary material to receive a uniform application of finish liquid. That is, the bundle of filamentary material is spread out in monolayer form so as to be readily accessible to the finish liquid. Pulsations in the flow of finish liquid are avoided by employing a plurality of feed capillaries 18 which each have a diameter less than 0.06 inches. Thus, no appreciable interruptions in the discharging flow will occur. By providing a common slot 22 at the outlet ends of the capillaries, no divider wall is present at the discharge point which would otherwise interfere with the flow of liquid at the region between adjacent capillaries. Thus, the filamentary material is subjected to a more uniform treatment, thereby increasing the overall quality of the finished product.

Although the present invention has been described in connection with preferred embodiments thereof, it will be appreciated by those skilled in the art that additions, modifications, substitutions, and deletions not specifically described, may be made without departing from the spirit and scope of the invention as defined in the appended claims.

What is claimed is:

1. A method for applying a finish liquid to a bundle of running filamentary material, said method comprising the steps of:

running said bundle of filamentary material in monolayer form through a common passage, conducting finish liquid under pressure through a supply duct and into at least two side-by-side capillaries which communicate with said duct and are each less than 0.06 inches in diameter and which are separated by a divider wall which terminates short of outlet ends of said capillaries whereby said outlet ends of said capillaries define part of a common slot, said slot being elongate transversely of the direction of travel of said filamentary material through said passage and having a cross-sectional area greater than the combined cross-sectional areas of said capillaries, liquid finish being discharged from said slot and onto the running monolayer of filamentary material.

2. A method according to claim 1, wherein said conducting step comprises conducting finish liquid through two side-by-side capillaries each having a diameter of about 0.03 inches.

3. A method according to claim 1, wherein said conducting step comprises conducting finish liquid through three side-by-side capillaries each having a diameter of about 0.02 inches.

4. A method according to claim 1, wherein said conducting step comprises conducting finish liquid through at least two side-by-side capillaries oriented substantially perpendicularly to said passage.

5. A method according to claim 1, wherein said conducting step comprises conducting finish liquid through at least two side-by-side capillaries which communicate with a slot having narrow ends and a wider center.

6. A method according to claim 1, wherein said conducting step comprises conducting finish liquid into said capillaries from a supply duct having a cross-section larger than the combined cross-sections of said capillaries.

7. An applicator for applying a finish liquid to a bundle of running filamentary material, said applicator comprising:

housing means having a passage formed therein, the width of said passage being at least as great as the sum of the diameters of the filamentary material so that the filamentary material forms a monolayer while running through said passage, a supply duct, at least two capillaries extending side-by-side through said housing means, said capillaries each having an inlet end communicating with said supply duct for receiving therefrom finish liquid under pressure and an outlet end, said capillaries being separated by divider wall means which terminates short of outlet ends of said capillaries such that said outlet ends define part of a common slot from which the finish liquid is discharged onto the running monolayer of filamentary material, said capillaries each having a diameter less than 0.06 inches, and said slot being elongate transversely of the direction of travel of said filamentary material through said passage and having a cross-sectional area greater than the combined cross-sectional areas of said capillaries.

8. Apparatus according to claim 7, wherein said slot has ends which are narrower than its center.

9. Apparatus according to claim 7, wherein there are two said capillaries each having a diameter of about 0.03 inches.

10. Apparatus according to claim 7, wherein there are three said capillaries each having a diameter of about 0.02 inches.

11. Apparatus according to claim 7, wherein said capillaries are oriented substantially perpendicularly to said passage.

12. Apparatus according to claim 7, wherein said supply duct has a cross-section which is larger than the combined cross-sections of said capillaries.

13. A method according to claim 1, wherein said conducting step comprises conducting finish liquid through a plurality of side-by-side capillaries disposed in a common plane oriented perpendicularly to said bundle of filaments.

14. Apparatus according to claim 7, wherein said capillaries lie in a common plane oriented perpendicularly to said bundle of filaments.

* * * * *